US005685735A

United States Patent [19]

Hohorst

[11] Patent Number: 5,685,735

[45] Date of Patent: Nov. 11, 1997

[54] ELECTRICAL TERMINAL WITH ACTUATING PRESS-BUTTON

[75] Inventor: Wolfgang Hohorst, Minden, Germany

[73] Assignee: WAGO Verwaltungsgesellschaft mbH, Minden, Germany

[21] Appl. No.: 581,317

[22] Filed: Dec. 29, 1995

[30] Foreign Application Priority Data

Jan. 4, 1995 [DE] Germany ..... 295 00 614.5 U

[51] Int. Cl.[6] ..... H01R 4/24

[52] U.S. Cl. ..... 439/441

[58] Field of Search ..... 439/438, 439, 439/440, 441, 516, 596

[56] References Cited

U.S. PATENT DOCUMENTS 4,846,722 7/1989 Heng et al. ..... 439/441

FOREIGN PATENT DOCUMENTS 544149 9/1959 Belgium ..... 439/439

3743410 6/1989 Germany ..... 439/438

*Primary Examiner*—P. Austin Bradley

*Assistant Examiner*—Tho Dac Ta

*Attorney, Agent, or Firm*—Salter & Michaelson

[57] ABSTRACT

The invention concerns an electrical terminal with a housing, which comprises an insulating material, and with an actuating push button, which consists of an insulating material and that is installed in a guidance channel in the housing in a manner whereby it is capable of axial displacement. It is proposed that the housing and the actuating push button be molded in one piece during the injection molding of the plastic and that the internal wall of the guidance channel be provided with a recess in the region in which the push button is capable of axial displacement, whereby the recess serves for accommodating the material bridge that is molded onto the push-button.

3 Claims, 1 Drawing Sheet

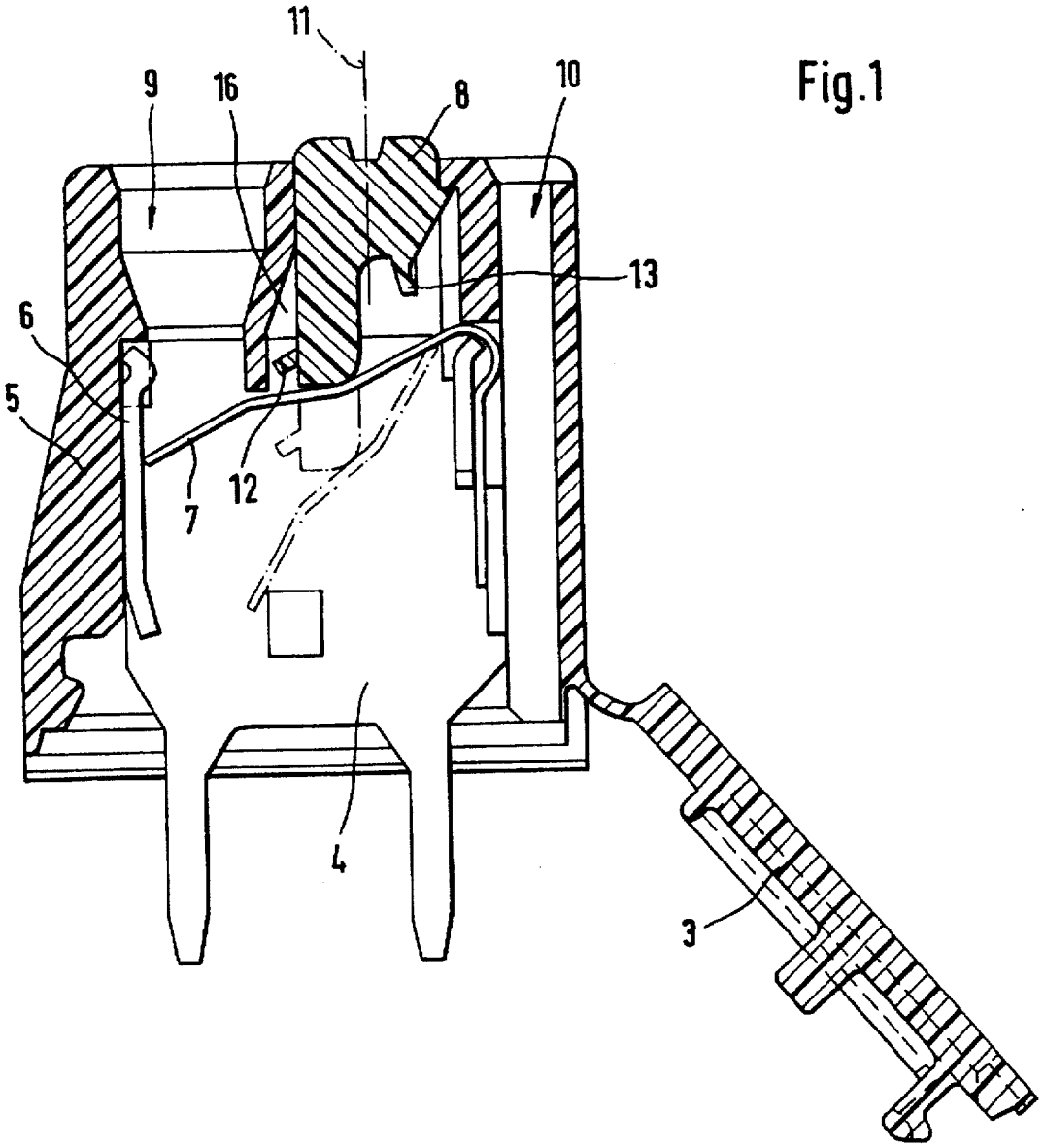
Fig.1
Fig.2
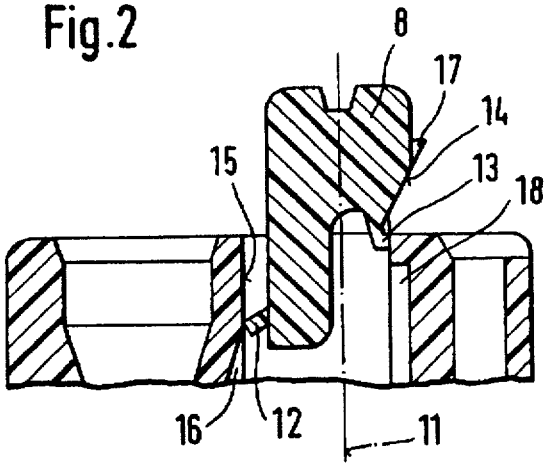

ELECTRICAL TERMINAL WITH ACTUATING PRESS-BUTTON

The invention concerns an electrical terminal that is capable of being actuated by means of an actuating press-button, which comprises an insulating material and that, for this purpose, is inserted into a guidance channel in the housing, which comprises an insulating material, and that is mounted in the guidance channel in a manner in which it is capable of axial displacement and that is molded in one piece with the housing, which comprises an insulating material, in such a way during the injection molding of the plastic that at least one thin (film-like) material bridge—with an intended break-off junction that is adjacent to the housing that comprises an insulating material—is present between the push-button and the housing, which comprises an insulating material, whereby the intended break-off junction snaps on inserting the push-button into the guidance channel.

Terminals of this type are known from Germany 3,514,098 A1 of the applicant. They have the advantage that the press buttons, which are injection molded in one piece with the housing, which comprises an insulating material, are capable of being installed fully automatically and inexpensively in their respective guidance channels by way of the feature that, in the simplest manner, they are merely pushed into the guidance channel, whereby the intended break-off junctions of the bridges, which comprise the material, will snap.

The intended break-off junction in question of a material bridge, can be selected in such a way that it is adjacent either to the terminal housing, which comprises an insulating material, or to the push-button. In the latter case, the remnant of the material bridge would then remain behind at the housing, which comprises an insulating material, after the snapping off of the intended break-off junction, whereby this is undesired in practice. If, however, the remnant of the material bridge remains behind at the push-button itself, then this can lead to malfunctions on actuating the push button since the remnant of the material bridge can interfere with the ability of the push button to be displaced in its respective guidance channel.

The problem of the invention is to propose a terminal of the aforementioned type with constantly interference-free actuation of the actuating push button.

This problem is solved by way of the feature that, in the region in which the push button is capable of axial displacement, the internal wall of the guidance channel has a recess for accommodating the material bridge that is molded onto the push button.

Such a recess for accommodating the material bridge and that remains behind at the push-button is preferably in the form of an accommodating groove that is somewhat larger than the maximum dimensions of the remnant of the material bridge and that remains behind at the push button and that extends in the axial direction of the guidance channel. This accommodating channel can extend through the guidance channel in its entirety and, in this case, it is then visible to an observer at the external surface of the terminal housing, which comprises an insulating material, provided that the head of the actuating push button does not cover the peripheral edges of the guidance channel, whereby this is usual if, in the state of rest, the head of the actuating push button seals this off in an approximately flush manner relative to the upper edge of the guidance channel (=sunken arrangement of the actuating push-button).

Such accommodating grooves of the terminal, which are open-ended toward the external surface, can become dirty and, as a result, they can cause malfunctions during later usage of the actuating push-button because of the dirt. In order to eliminate these later possibilities for malfunctioning too, features are provided in accordance with an advantageous form of embodiment of the invention such that the material bridge is molded on in the region of the lower end of the push-button that extends into the interior of the terminal housing, which comprises an insulating material, and that the recess for accommodating the material bridge is constructed in closed form in the direction of the upper end that points toward the external surface of the housing, which comprises an insulating material.

Basically, one can start out from the situation in which the plastic material of the push button and of the housing, which comprises an insulating material, possesses adequate elasticity so that—upon axially inserting (installing) the push button in its respective guidance channel—the remnant of the material bridge, which remains behind at the push-button, is pushed into the accommodating groove despite the upper closed end thereof.

However, the installation (insertion) of the push button into a guidance channel with an accommodating groove that is closed at the top is significantly more problem-free if, in accordance with a further form of embodiment of the invention the push button has a starting slope on the Side that lies opposite the material bridge that is molded onto the push button in such a way that the push button carries out a lateral displacement movement transversely to the axis of the guidance channel upon pushing it into its guidance channel. As a result, the remnant of the material bridge, that remains behind at the push button moves into the accommodating groove of the guidance channel without forced fitting thereof.

Such a form of embodiment of the invention also has the advantage that a second material bridge that is formed during injection molding between the push-button and the housing, which comprises an insulating material—namely on the side of the push button that has the starting slope—cannot basically cause malfunctions in terms of the current or later functionality of the push button. [This is] because—as a result of the lateral displacement movement of the push button upon pushing it in its guidance channel—not only is this second material bridge snapped off, but also the remnants of the material bridge are also clearly moved away as a result of the lateral displacement movement and they thus remain basically "out of operation" during the functional actuation of the push button.

An example of an embodiment of the invention will be described in more detail below on the basis of the drawings. The following aspects are shown.

FIG. 1 shows a cross section through the terminal in accordance with the invention in the usage state;

FIG. 2 shows the position of the push button in accordance with FIG. 1 during the injection molding of the plastic.

The terminal that is illustrated in FIG. 1 is a circuit board terminal that can be constructed with or without the injection molding onto it of the lower closure cover 3.

The contact insert 4 is inserted in its entirety from below into the housing 5, which comprises an insulating material, in accordance with the illustration. It [the contact] consists, in essence, of the contact frame 6 and the contact spring 7 that can be brought into the "opened" position—in the way in which this is illustrated by the dashed/dotted lines in FIG. 1—by means of the push-button 8.

The clamping of the conductor takes place between the trailing edge of contact spring 7 at the front and contact frame 6 in the position of the contact spring that is illustrated in fully extended form in Fig. 1. The electrical conductor (not shown), that is to be clamped in this way, is led via the conductor guide opening 9 to the clamping site.

The circuit board terminal that is illustrated also possesses a test plug connection 10 in the form in which this is known in principle.

An essential aspect of the invention is the constructional configuration of push button 8 and the guidance channel into which the push button is inserted in the usable state, whereby it is installed in a manner in which it is capable of axial displacement in the direction of its axis 11.

FIG. 2 shows push button 8 in the position that it takes up in the case of bridged injection molding with the terminal housing, which comprises an insulating material. In this injection position, it is connected to the housing, which comprises an insulating material, via two material bridges 12 and 13, whereby the intended break-off junctions of the material bridges are provided in each case in such a way that they are directly adjacent to the housing, which comprises an insulating material.

In addition, the push button possesses a starting slope 14 on the side that lies opposite material bridge 12, in such a way that push-button 8 carries out a lateral displacement movement upon being pushed into its guidance channel up to the usage position that is illustrated in FIG. 1, whereby—on comparing FIG. 1 and FIG. 2—the displacement movement is recognizable by the clear lateral displacement of axis 11 of push button 8.

The intended break-off junction of material bridge 13, snaps during this lateral displacement movement and FIG. 1 shows that the remnant of material bridge 13, that remains behind at the push-button has no contact with the guidance channel in the usage state of the terminal, so that interference in the functioning of the push button cannot arise therefrom.

In regard to material bridge 12, the feature has been provided in accordance with the invention that the internal wall 15 of the guidance channel has an accommodating groove 16 for accommodating the remnant of material bridge 12 that remains behind at push-button 8. This accommodating groove is constructed in closed form in the direction of the upper end of the accommodating groove that points toward the external surface of the housing, which comprises an insulating material, i.e. in the usage state of the terminal, push button 8 and internal wall 15 of the guidance channel lie on the external surface of the housing, which comprises an insulating material, in a such way that they fit one another accurately so that any possible penetration of dirt or similar material into the interior of the housing, which comprises an insulating material, is prevented.

Despite the adjacency of wall 15 to push button 8 in an accurately fitting manner, the remnant of material bridge 12, which remains behind at the push button, cannot produce malfunctions in the usage state of the terminal, since it is located—in a contact-free manner—in accommodating groove 16 and in no case hinders the ability of the push button to be displaced axially in the guidance channel.

In the case of the example of embodiment that is illustrated, starting slope 14 has been combined with a retention nose 17 that runs in a groove 18, provided for the retention nose, after pushing push button 8 into the guidance channel, and this prevents unintentional removal or falling out of the push button from the guidance channel.

I claim:

1. Electrical terminal that is capable of being actuated by means of an actuating push button, which consists of an insulating material and that, for this purpose, is inserted in a guidance channel in the terminal housing, which comprises an insulating material, and is installed in the guidance channel in a manner whereby it is capable of axial displacement and that, during the injection molding of the plastic, it is molded in one piece with the housing, which comprises an insulating material, in such a way that at least one thin (film-like) material bridge—with an intended break-off junction that is adjacent to the housing, which comprises an insulating material—is present between the push button and the housing, which comprises an insulating material, whereby the intended break-off junction snaps on inserting the push-button into the guidance channel, characterized by the feature that, in the region in which push button (8) is capable of axial displacement, internal wall (15) of the guidance channel has a recess (16) for accommodating material bridge (12) that is molded onto the push button.

2. Terminal in accordance with claim 1, further characterized by the feature that the material bridge (12) is molded on the region of the lower end of push-button (8) that extends into the interior of terminal housing (5), which comprises an insulating material, and that recess (16) for accommodating bridge (12), which comprises the material, is constructed in closed form in the direction of the upper end of the recess that points toward the external surface of the housing, which comprises an insulating material.

3. Terminal in accordance with claim 2, further characterized by the feature that, on the side that lies opposite material bridge (12) and that is molded onto the push button, push button (8) has a starting slope (14) such that, upon pushing it in its guidance channel, the push-button carries out a lateral displacement movement that is transverse to an axis of the guidance channel.

* * * * *